US005784855A

United States Patent [19]

Focke et al.

[11] Patent Number: 5,784,855

[45] Date of Patent: Jul. 28, 1998

[54] APPARATUS FOR THE PRODUCTION OF, IN PARTICULAR, CIGARETTE PACKS

[75] Inventors: Heinz Focke, Verden; Hans-Jurgen Bretthauer, Bremen, both of Germany

[73] Assignee: Focke & Co., Verden, Germany

[21] Appl. No.: 735,636

[22] Filed: Oct. 23, 1996

[30] Foreign Application Priority Data

Oct. 24, 1995 [DE] Germany ..... 195 39 417.8

[51] Int. Cl.[6] ..... B65B 19/22; B65B 61/00

[52] U.S. Cl. ..... 53/53; 53/234

[58] Field of Search ..... 53/53, 54, 52, 53/234, 225, 251, 253

[56] References Cited

U.S. PATENT DOCUMENTS

| | | | |
|---|---|---|---|
| 3,479,787 | 11/1969 | Bardenhagen et al. | 53/53 X |
| 3,517,477 | 6/1970 | Thornton | 53/53 |
| 3,590,556 | 7/1971 | Focke | 53/53 |
| 3,721,340 | 3/1973 | Kruse et al. | 53/53 X |
| 3,782,523 | 1/1974 | Giatti . | |
| 4,858,770 | 8/1989 | Gamberini | 53/53 X |
| 4,947,617 | 8/1990 | Focke et al. | 53/234 |

FOREIGN PATENT DOCUMENTS

| | | |
|---|---|---|
| 605838 | 7/1994 | European Pat. Off. . |
| 2216179 | 8/1974 | France . |
| 1958738 | 6/1971 | Germany . |
| 3219001 | 12/1982 | Germany . |
| 3701768 | 8/1988 | Germany . |
| 4102028 | 9/1991 | Germany . |
| 2359825 | 9/1994 | Germany . |
| 4134438 | 11/1994 | Germany . |
| 4429692 | 3/1995 | Germany . |

*Primary Examiner*—James F. Coan

*Attorney, Agent, or Firm*—Sughrue, Mion, Zinn, Macpeak & Seas, PLLC

[57] ABSTRACT

An apparatus for the production of packs (10), especially cigarette packs. In the manufacture of packs (10) by a packaging machine, it may be desirable, for several reasons, to separate individual predetermined packs out of the feed flow and to supply them for suitable use. This involves, in particular, faulty packs (23) which are gripped by an outward-transfer wheel (26) in the region of a separating-out assembly and are transferred to a separate pack conveyor (45).

16 Claims, 6 Drawing Sheets

37
26
27
29
28
30
30
31
29
69
30
64
69
65
65
38
66
68
67
33
43
40
35
41
39
68
67
32
36
65
69
64
30
30
66
28
31
29
29
27
29
37
VII

APPARATUS FOR THE PRODUCTION OF, IN PARTICULAR, CIGARETTE PACKS

BACKGROUND OF THE INVENTION

The invention relates to an apparatus for the production of packs, in particular cigarette packs, of which the pack content—a cigarette group—is wrapped in the region of a folding assembly—folding turret—into at least one blank of packaging material, the packs thus formed being transported away via a discharge conveyor, individual, selected, completely or partially completed packs being capable of being conveyed away by an and-less conveyor and of being supplied to a separate conveyor.

In packaging machines, in particular cigarette-packaging machines, it may be necessary to transfer individual selected packs out of the feed flow, that is to say not supply them to the discharge conveyor for the finished packs. The packs to be separated out are primarily faulty packs, a fault in which was identified in the region of a test station.

SUMMARY OF THE INVENTION

The invention is concerned with packaging machines of this type. The object on which the invention is based is to improve the separating out of selected pack from the transport flow of the packaging machine, in particular, at the same time, to take into account the high performance and consequently the high conveying speeds of packaging machines.

To achieve this object, the apparatus or packaging machine according to the invention is characterized by the following features:

a) the packs to be conveyed away can be removed from the endless conveyor, in particular a band conveyor, by being lifted off by an extraction conveyor, b) the extraction conveyor is designed as a rotary-driven outward-transfer wheel which, on the circumference, has a plurality of holders mounted at equal distance from one another and each intended for the controlled gripping of a pack, c) the outward-transfer wheal is rotatable in synchronism with the band conveyor (for the packs), d) to grip a pack, a holder belonging to the outward-transfer wheel and assigned to the pack can be activated when it comes to bear on the pack.

The outward-transfer wheel is arranged, according to the invention, in such a way that it is driven in rotation in a vertical plane, specifically above the preferably curved band conveyor. The packs to be transferred out are gripped, lifted off from the band conveyor along a short path in the form of an arc of a circle and deposited on a separate conveyor, namely on a pack conveyor. The packs not to be transferred out are transported further on the band conveyor until they are passed on to the discharge conveyor.

The pack conveyor for transporting away the separated-out packs is designed in a particular way, namely as a conveying duct, in which the packs can be transported by means of an air stream.

A further particular feature is that, for receiving the separated packs, the pack conveyor is provided with a branch-off conveyor which affords the possibility of transferring out packs of different types. These cam be, on the one hand, faulty packs and, on the other hand, correctly fixed packs which are separated out in the manner of random sampling for checking purposes or for other reasons.

Further features of the invention relate to the design of the outward-transfer wheal for the extraction of the packs and to the design and positioning of the pack conveyor and of the branch-off conveyor for transporting away the separated-out packs.

Further particulars of the invention are explained in more detail below by means of an exemplary embodiment represented in the drawings, in which:

DESCRIPTION OF A PREFERRED EMBODIMENT

Figure 1:
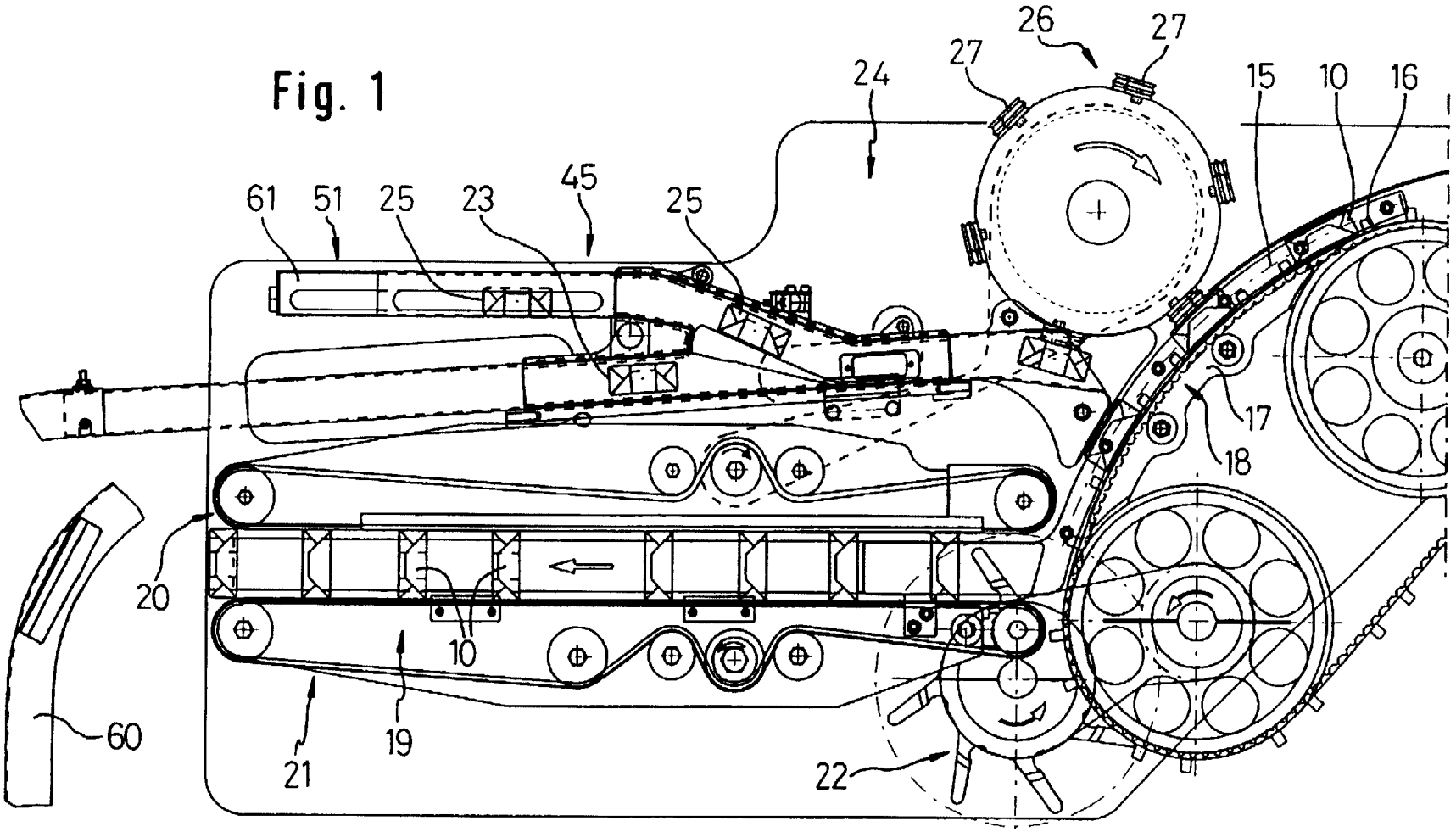
FIG. 1 shows a side view of a region of a packaging is machine having a device for separating out individual packs.

Details of a packaging machine for packs 10, namely cigarette packs, are shown as an example in the drawings. In actual fact, these packs are soft-cup packs, that is to say a type of cigarette pack 10, in which a cigarette group is wrapped in an inner blank of paper or tin foil and a cigarette block thus formed is wrapped in a paper cup. The pack 10 has a cubed shape with a large-area front wall 11, an opposite rear wall 12 and elongate narrow side walls 13 and 14.

In the present example, the packs 10 are located in the exit region of a packaging machine. The packs 10 have left a drying turret and are transported by a band conveyor 15. This is part of a packaging machine, as shown and described in detail in EP 605,838.

The band conveyor 1S convoys the packs 10, correctly positioned between drivers 16, in ouch a way that the packs 10 are at a clear distance from one another in the conveying direction. The band conveyor 15 consists of a toothed belt which is guided on an arcuate band 17 and which forms an arcuate conveying strand 19 for the packs 10.

The packs 10 are supplied by the band conveyor 15 to a discharge conveyor 19. The latter transports the packs 10 at the predetermined distance from one another for a further intended use, for example to a packaging machine for applying an outer wrapping composed of film. The discharge conveyor consists, here, of an upper conveyor belt 20 and of a lower conveyor belt 21. The packs 10 are transported between mutually confronting, essentially horizontally running conveying strands of these conveyor belts 20 and 21, specifically in such a way that the transversely directed side walls 13, 14 facing upwards and downwards rest against the conveying strands of the conveyor belts 20, 21.

The packs 10 delivered by the band conveyor 15 are not passed on directly from this to the discharge conveyor 19, but via an intermediate conveyor in the form of a star wheel 22. The latter picks up the packs 10 from the conveying strand 18 of the band conveyor 15 in succession and passes them on to the discharge conveyor 19.

For various reasons, it in necessary or desirable to separate out individual predetermined packs 10 from the above-described feed flow. This applies particularly to incorrectly formed packs 10, that in to say faulty packs 23. The fault may, in this came, be a deficient formation or deficient number of cigarettes or defective wrapping. The faults are identified at another suitable location on the packaging machine. A control signal derived from this in supplied to a separating-out assembly 24. Thin transfer the relevant faulty pack 23 out of the transport flow, in the present case in the region of the band conveyor 15. Furthermore, the separating-out assembly 24 can separate out sample packs 25, that is to may intact packs 10 which are supplied, for example, for checking.

The separating-out assembly 24 consists, here, of two part assemblies, each important in itself. One of these is an extraction conveyor for the packs 10 which, here, in designed an an outward-transfer wheel 26. The other is a discharge-conveyor system for the packs 10 transferred out.

The outward-transfer wheel 26 is a cylindrical structure with receptacles 27 arranged along the circumference and each intended for a pack 10 to be transferred out. The outward-transfer wheel 26 is in such a relative position in relation to the path of movement of the packs 10 that the packs 10 to be gripped are gripped by one of the receptacles 27 in the region of the radially outward-directed free pack face, namely on the large-area front wall 11.

Figure 7:
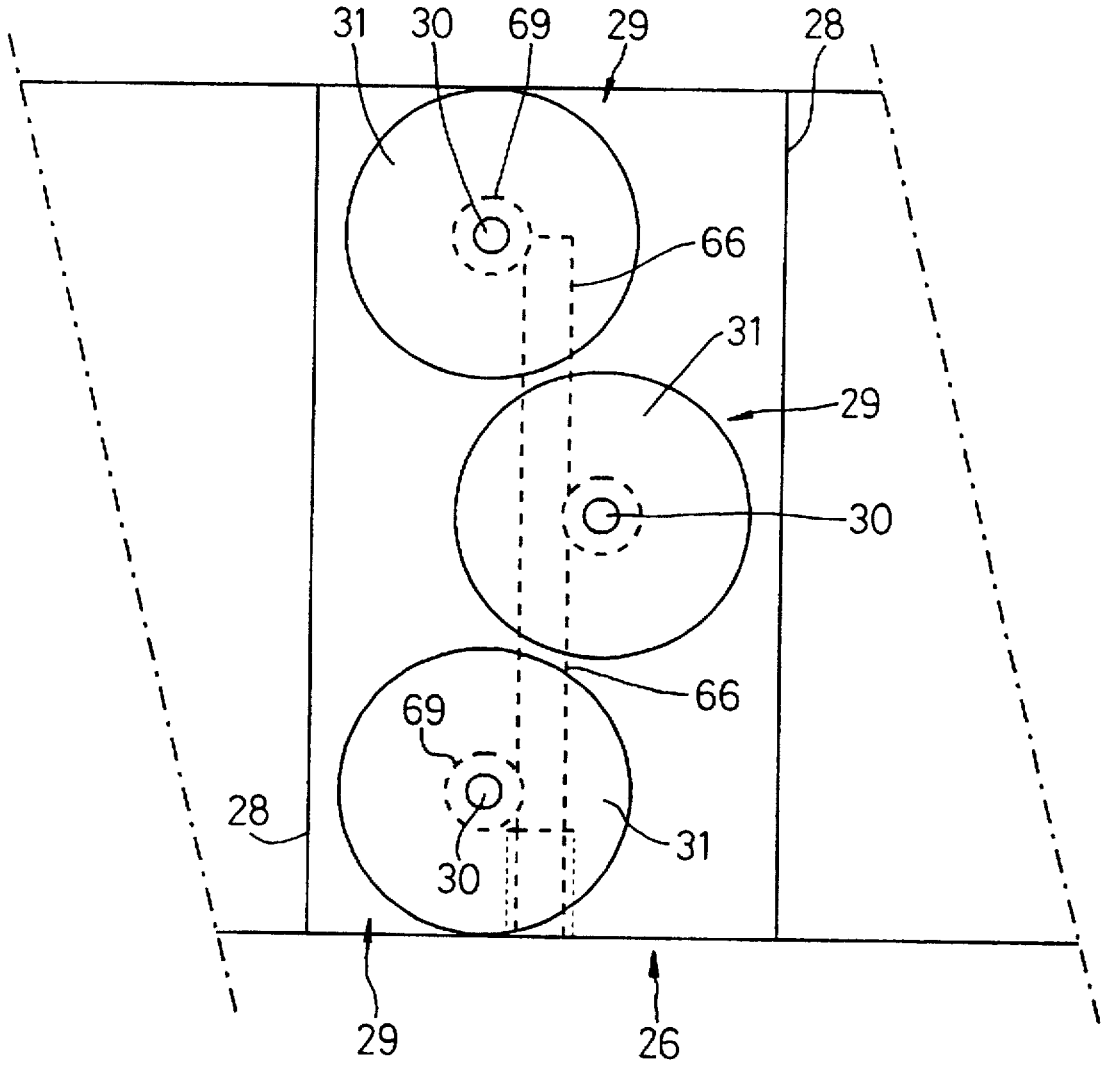
FIG. 7 shows a radially directed view of the outward-transfer wheal in the region of auction heads.

The receptacles 27 are arranged on the outward-transfer wheel 26 in each case in the region of bearing faces 28 of the latter which run tangentially, that is to say are formed by flattening. The receptacles 27 consist of members which grip and hold the pack 10 by suction air, that is to may by vacuum and suction. In the present exemplary embodiment, each receptacle 27 consists, for this purpose, of a plurality of, here three auction heads 29. The (three) auction heads 29 are arranged next to one another in the axial direction of the outward-transfer wheel 26 in the region of the planar bearing face 28. In the example shown (FIG. 7), the middle suction head 29 is arranged offset in the circumferential direction relative to the near-edge suction heads 29. The suction heads 29 consist of elastic material, in particular rubber. Radially directed suction bores 30—in the present example, a central suction bore 30 in each case—open out on outer circular bearing faces 31 of the suction heads 29. When a pack 10 is received by the outward-transfer wheel 26, the function heads 29 bear with their bearing faces 31 on the pack face facing upwards or outwards and are held by the vacuum.

The suction heads 29, circular or cylindrical here, are preferably designed as rubber/metal elements with a metallic carrier plate (not shown) and with a metallic threaded pin 69 attached to the latter. The threaded pin is seated by means of an external thread in a threaded bore 64 of the bearing face 28. The (central) suction bore 30 leads through the threaded pin 69 to a radial connecting bore 65 in the outward-transfer wheel 26. The connecting bores 65 of the suction heads 29 are connected to one another by means of an axis-parallel transverse bore 66.

Figure 5:
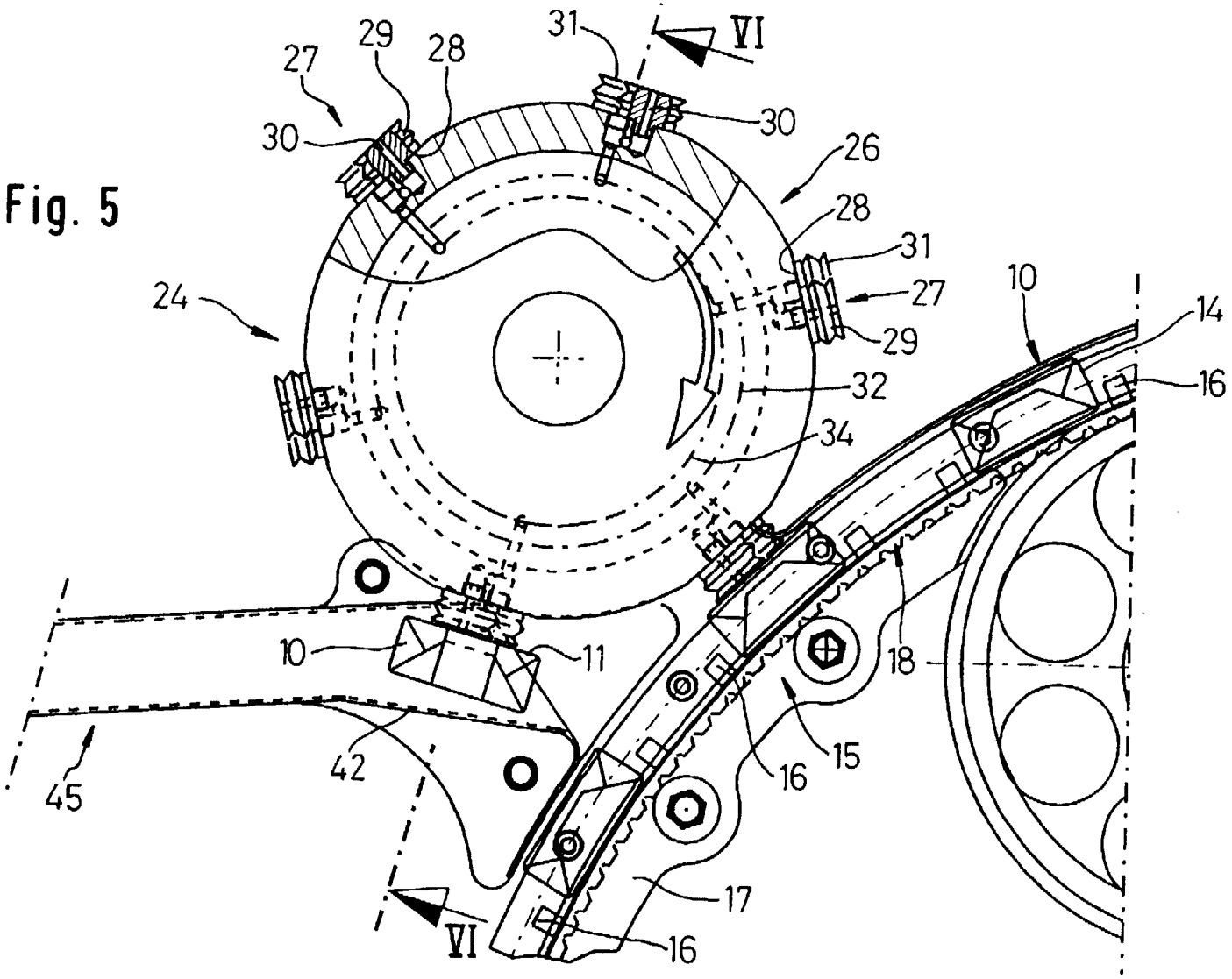
FIG. 5 shows a side view of an outward-transfer wheel for separating out individual packs on an enlarged scale.
Figure 6:
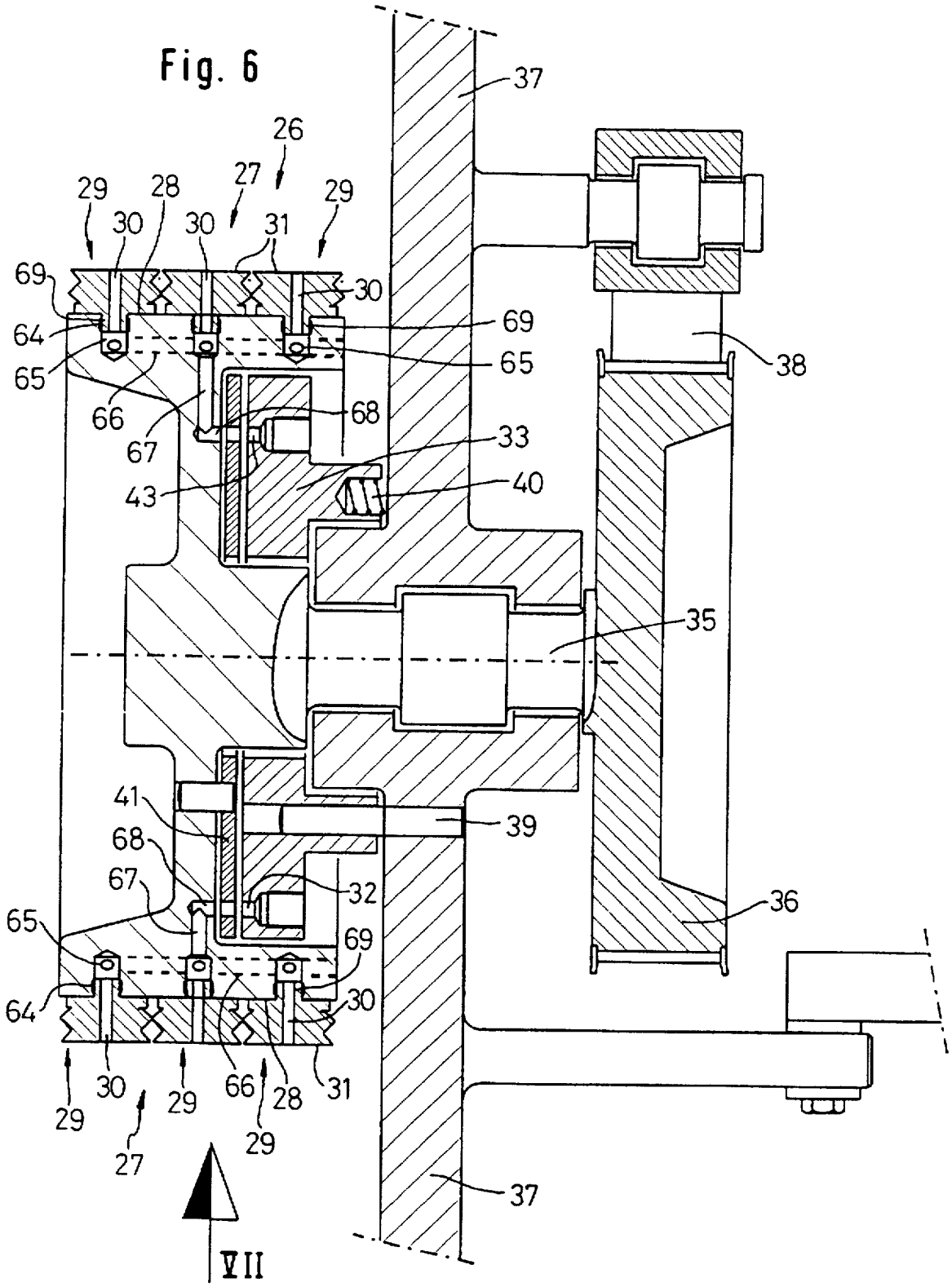
FIG. 6 shows a representation of the outward-transfer wheel in a diagonal section in the sectional plane VI—VI of FIG. 5.

The common transverse bore 66 is connected via a radial bore 67 to an axis-parallel bore 68 which itself leads to a duct segment 32 in the region of a stationary supporting member 33. The duet segments 32 are arranged in the supporting member 33, designed as a supporting disc, mg open grooves in the form of an arc of a circle (FIG. 5). During the rotational movement of the outward-transfer wheel 26, the auction bores 30 or the bores 68 connected to these come into overlap with the duct segments 32. During this phase of the rotational movement, the suction bores 30 are connected to a vacuum source. As in evident from FIG. 5, the duct segments 32 are located in the region of take-over of a pack 10 from the band conveyor 15.

A further particular feature is that the receptacles 27 can be controlled separately in respect of the take-over of packs 10. In the present exemplary embodiment, two concentrically arranged duct segments 32 and 34 are provided for this purpose. The radial bores 67 and the transversely directed bores 68 connected to theme are positioned in such a way that one group of receptacles 27 is assigned to the radially outer duct segment 32 and the other receptacles 27 are assigned to the radially inner duct segment 34. The arrangement is such that the receptacles 27 are assigned alternately to one duct segment 32, 34 and the other in the direction of rotation of the outward-transfer wheal 26. The duct segments 32, 34 are connected to the common vacuum source via their own shut-off valves. The shut-off valves are switched according to the receptacle 27 to be loaded. This ensures that, via one channel segment 32, 34 or the other, in each case the active receptacle 27 is loaded with suction air for the purpose of gripping a pack. This avoids the situation where a pack 10 following in the conveying direction is also taken over by a subsequent receptacle 27 as a consequence of the extremely short cycle times and the inertia of the switching operations.

The pot-like outward-transfer wheel 26 is connected to a driving wheal 36 via a drive shaft 35. The drive shaft 35 is mounted in a supporting wall 37 of a machine stand. The driving wheel 36 is driven by a belt drive having a toothed belt 38.

The stationary supporting member 33 is mounted fixedly in terms of rotation on the drive shaft 35 by means of a pin 39 and is supported elastically on the supporting wall 37 by means of springs 40. Positioned between the supporting member 33 and the outward-transfer wheel 26 is a starting disc 41. This rotates together with the outward-transfer wheel 26. The starting die 41 Consist of a material having high abrasion resistance, for example of carbon. The bore 68 leads through this starting disk 41. The latter bears closely against the supporting member 33.

The pack 10 gripped by the outward-transfer wheel 26 in taken up by the receptacle 27 over a short conveying stage, namely a conveying path in the form of an arc of a circle, and is supplied to a conveyor for the separated-out packs 10. These are deposited on the platform 42 and then transported further.

For this passing-on operation, the auction air of the receptacles 27 which actor on the auction members in cancelled instead, the packs 10 are briefly loaded with compressed air in the depositing region, specifically via the above-described duct system for vacuum transmission. For this purpose, duct segments are formed in the supporting member 33 in the relevant region of the rotational movement of the outward-transfer wheel 26. These duct segments are likewise designed as a part arcs of a circle and connected to a compressed-air source. A reliable and accurate release and depositing of the pack 10 above the platform 42 is thereby guaranteed. The description relating to the vacuum system similarly applies to the control of the compressed air to the receptacles 27. The receptacles 27 are assigned alternately to one duct segment and the other.

The platform is the upwardly open initial region of a pack conveyor 45. The latter commences here in the immediate vicinity of the band conveyor 15. The pack conveyor 45 transports the aspirated-out packs 10, namely faulty packs 23 and sample packs 25, separately from the discharge conveyor 19.

In this example embodiment, the pack conveyor 45 is designed as a conveying duct with a closed rectangular duct cross-section. The packs 10 are conveyed within the pack conveyor 45 by means of compressed air. An air stream is conducted into the duct-shaped pack conveyor 45 in the direction of flow via air nozzles 46, 47. In the present exemplary embodiment, a plurality of air nozzles 46, 47 are mounted at a distance from one another in the conveying direction on an upper wall 48 of the pack conveyor 45.

Figures 2, 3:
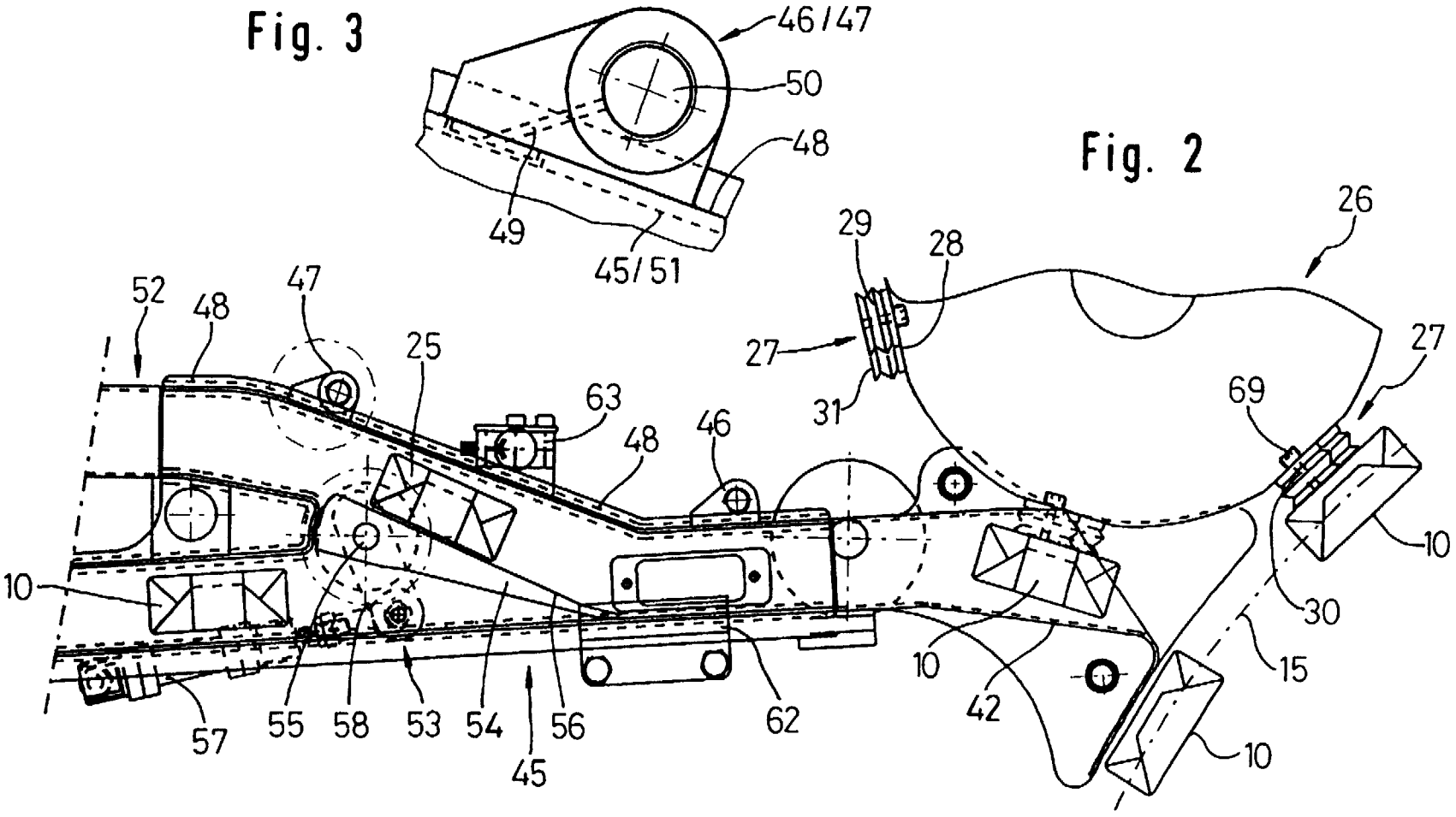
FIG. 2 shows a detail of the representation in FIG. 1 on an enlarged scale.
FIG. 3 shows a detail of the apparatus, namely a blowing nozzle, on a further-enlarged scale.
Figure 4:
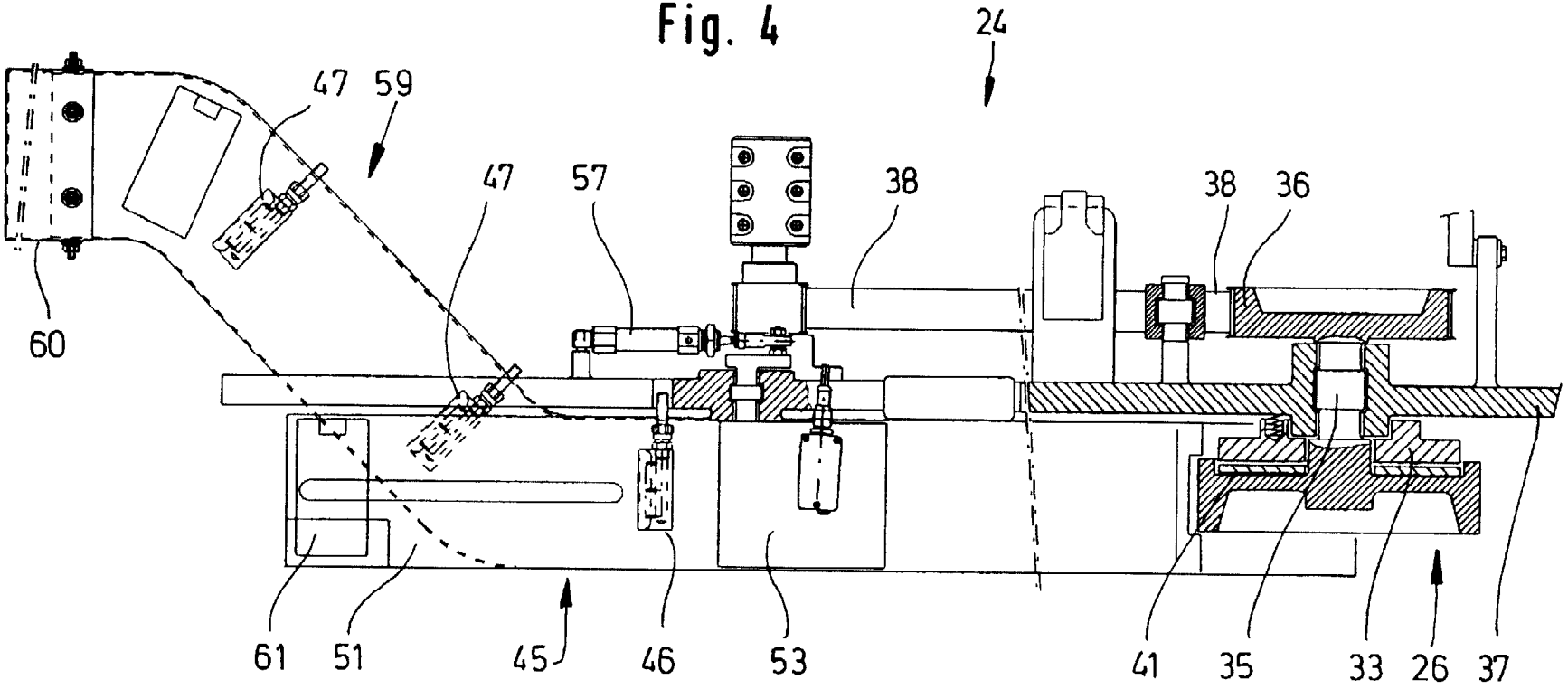
FIG. 4 shows a plan view of the assembly for separating out the packs, partially in horizontal section.

FIG. 3 shows an exemplary embodiment of an air nozzle 46, 47 of this type. A nozzle duct 49 directed at an acute angle to the upper wall 48 opens out in the pack conveyor 45. The nozzle duct 49 is connected to a transversely directed air conduit 50. The latter is connected to a compressed-air source.

The packs 10 transferred out are separated according to the type of pack in the region of the pack conveyor 45. For this purpose, a branch-off conveyor 51 adjoins the pack conveyor 45 at an acuts angle. Installed in the region of a branch-off 53 is a deflector 52 which, depending on the type of pack, transports the packs 10 further in the pack conveyor 45 or guides them into the branch-off conveyor 51. Sample packs 25 are preferably supplied to the branch-off conveyor 51.

The deflector 52 consists of a guide element 54 in the form of a wedge-shaped body tapering acutely or sharply. The latter is mounted movably, namely pivotably about a rotary bearing 55, within the duct-shaped pack conveyor 45 in the region of the branch-off 53. In one end position (FIG. 2), the guide element 24 is positioned in such a way that the pucks 10 or sample packs 25 travel on an upper sliding face 56 into the branch-off conveyor 51. In another position, in which a free end facing the platform 42 is moved into an upper position, the guide element 54 forms a closure for the branch-off conveyor 51. Instead, the pack conveyor 45 is opened up continuously. The guide element 54 is actuated via a lover arm 58 by means of a cylinder 57.

The pack conveyor 45 and branch-off conveyor 53 are arranged in a relative position in relation to the discharge conveyor 19 such that mutual disturbances are avoided. The pack conveyor 45 and branch-off conveyor 51 are arranged above the discharge conveyor 19. The branchoff conveyor extends above the pack conveyor 45. The latter is, in turn, provided with an offset piece 59, that is to say a laterally directed diversion, as seen in a plan view. The end of the offset piece 59 is therefore located above the discharge conveyor 19 and offset laterally relative to the latter. The faulty packs 23 transported via the branch-off conveyor 51 can thus pass into a discard shaft 60. The sample packs 2S transported in the branch-off conveyor 51 can be extracted at an open end 61.

The conveying system described is assigned particular monitoring members. Located in the region of the pack conveyor 45 is a light barrier 62 (the holder for this is represented), by means of which the degree of filling of the pack conveyor 45 is monitored. Consequently, no further packs 10 can be transferred out and supplied to the pack conveyor 45 when the latter is full. In the region of the branch-off conveyor 52 too, a light barrier 63 is mounted in the region of the deflector or of the guide element 54, so that the latter cannot be adjusted when a pack is located in this region.

What is claimed is:

1. An apparatus for the production of packs (10), each having a pack content which is wrapped in a folding assembly by a blank of packaging material, said apparatus comprising:

a) a discharge conveyor (19);

b) a band conveyor (15) which is associated with said folding assembly and from which the packs (10) are transferred to said discharge conveyor (19), said band conveyor (15) having a conveying strand (18) on which the packs (10) lie;

c) a pack conveyor;

d) an outward-transfer wheel (26), associated with said band conveyor (15), for removing individual, selected ones of said packs (10) from said conveying strand (18) and for conveying the removed packs to said pack conveyor (45) for further transportation of the removed packs;

e) means for rotating said outward-transfer wheel (26) in a vertical plane in synchronism with said band conveyor (15);

f) a plurality of receptacles (27) which are mounted on a circumference of said outward-transfer wheel (26) at a distance from one another and which are adapted for controlled gripping of the individual packs (10), g) the receptacles (27) having suction heads, pressurized by a partial vacuum, for gripping the packs (10); and h) means for controlling the partial vacuum so that the receptacles grip only said individual, selected packs (10), while all other packs remain on the conveying strand (18) for transfer to said discharge conveyor (19).

2. The apparatus according to claim 1, wherein the suction heads (29) for gripping the individual, selected packs (10) have suction bores (30), and further comprising shut-off valves for connecting said suction heads to a vacuum source, and for disconnecting said suction heads from the vacuum source so that they do not grip the remaining packs (10).

3. The apparatus according to claim 2, further comprising means for activating the suction heads (29) in at least two groups independently of each other for the purpose of gripping the packs (10) so that the suction bores (30) of the receptacles (27) succeeding one another in the circumferential direction of the outward-transfer wheel (26) are alternately coupled to different said shut-off valves for connection to the vacuum source.

4. The apparatus according to claim 1, wherein the suction heads (29) grip by suction the selected packs (10) in a region of a large-area front wall (11) of each pack.

5. The apparatus according to claim 1, wherein the receptacles (27) are made of elastic material, and each receptacle has at least one radially directed suction bore (30), said suction bores opening out in a region of radially outer bearing faces (31) of the suction heads (29).

6. The apparatus according to claim 5, wherein said suction heads (29) are arranged next to one another in an axial direction of the outward-transfer wheel (26) in a region of a radial bearing face (28) of the outward-transfer wheel (26).

7. The apparatus according to claim 1, further comprising means for driving the outward-transfer wheel (26) at a same circumferential speed as the band conveyor (15), the distances between the receptacles (27) on the circumference of the outward-transfer wheel (26) corresponding to distances between the packs (10), which latter distances are determined by drivers (16) on the band conveyor (15).

8. The apparatus according to claim 2, further comprising a plurality of fixed air duct segments (32, 34) which are formed on a stationary supporting member (33) and on an arc of a circle, which are connected to said vacuum source, and which are coupled to various ones of said suction bores (30) so that said receptacles (27), succeeding one another in the direction of rotation of said outward-transfer wheel (26), are coupled alternately to one duct segment (32, 34) or another.

9. The apparatus according to claim 1, wherein the packs (10) to be removed are gripped, in a region of a conveying path, in the form of an arc of a circle, of the band conveyor (15) on a radially outer upper side thereof, by the outward-transfer wheel (26) rotating in the vertical plane above the band conveyor (15), are transported along a part circle, and are deposited at a starting end of said pack conveyor (45) arranged in the same vertical plane as the outward-transfer wheel (26) and the band conveyor (15).

10. The apparatus according to claim 1, further comprising, for releasing the packs (10) held in the receptacles on the outward-transfer wheel (26) and for depositing the packs on a platform (42) of said pack conveyor (45), means (28) for loading the suction bores (30) with compressed air, by connecting them to a compressed-air source.

11. The apparatus according to claim 1, wherein the pack conveyor (45) for transporting the removed packs (10) is a conveying duct with a closed cross-section, and further comprising means for producing an air stream to convey the removed packs within the pack conveyor (45) by an air stream, an entry region of the pack conveyor being designed as a platform (42) on which the packs (10) are deposited.

12. The apparatus according to claim 11, wherein said producing means comprises a plurality of air nozzles (46, 47) which succeed one another in the conveying direction and which are mounted on the pack conveyor (45), the air nozzles (46, 47) conducting the air stream, pointing in the conveying direction, into the pack conveyor (45).

13. The apparatus according to claim 1, further comprises a branch-off conveyor (51) for conveying away sample packs (25) on the pack conveyor, wherein said branch-off conveyor adjoins the pack conveyor (45) at a branch off (53) of the pack conveyor (45).

14. The apparatus according to claim 13, wherein there is formed in a region of the branch-off (53) for the branch-off conveyor (51), within the pack conveyor (45), a deflector (52) for guiding the packs (10) either into the branch-off conveyor (51) or further along the pack conveyor (45).

15. The apparatus according to claim 13, wherein the branch-off conveyor (51) branches off from the pack conveyor (45) in an upward direction so that the branch-off conveyor (51) runs in a plane above the pack conveyor (45).

16. The apparatus according to claim 1, wherein the pack conveyor (45) runs above the discharge conveyor (19), in such a way that a free end of the pack conveyor (45) runs at a lateral offset relative to the discharge conveyor (19), as seen in the vertical direction.

* * * * *